United States Patent [19]

Gallitzendörfer

[11] 4,348,929

[45] Sep. 14, 1982

[54] WAVE FORM GENERATOR FOR SOUND FORMATION IN AN ELECTRONIC MUSICAL INSTRUMENT

[76] Inventor: Rainer J. Gallitzendörfer, Hochstrasse 8, Karlsfeld, Fed. Rep. of Germany

[21] Appl. No.: 162,310

[22] Filed: Jun. 23, 1980

[30] Foreign Application Priority Data

Jun. 30, 1979 [DE] Fed. Rep. of Germany ..... 2926548

[51] Int. Cl.[3] ..... G10H 1/00

[52] U.S. Cl. ..... 84/1.01; 84/1.24; 84/1.28

[58] Field of Search ..... 84/1.01, 1.19, 1.26, 84/1.28, 1.03, 1.24

[56] References Cited

U.S. PATENT DOCUMENTS

| | | | |
|---|---|---|---|
| 3,847,349 | 11/1974 | Eastty | 364/723 |
| 4,101,964 | 7/1978 | Betts | 364/724 |
| 4,164,020 | 8/1979 | Griffith | 364/718 |
| 4,184,403 | 1/1980 | Whitefield | 84/1.26 |

FOREIGN PATENT DOCUMENTS

| | | | |
|---|---|---|---|
| 2549050 | 5/1977 | Fed. Rep. of Germany | 364/723 |

OTHER PUBLICATIONS

Johnson, "Interpolation–A Link Between Programmed Points and Smooth Curves", in Control Engineering, Sep. 1958, p. 153.

*Primary Examiner*—J. V. Truhe
*Assistant Examiner*—Forester W. Isen
*Attorney, Agent, or Firm*—Darby & Darby

[57] ABSTRACT

A waveform storage and generating system is disclosed in which at least two waveforms are stored. Values of the first waveform are sequentially read out, and smoothing to eliminate step noise is performed. In order to smoothly shift to reading out the second waveform, one or more transitional waveforms are derived which represent amplitude values between the first and second waveforms. The process of reading out the first, transitional, and second waveforms to provide a smooth transition is referred to as cross-fading. Several embodiments, including a microprocessor oriented system are disclosed.

17 Claims, 11 Drawing Figures

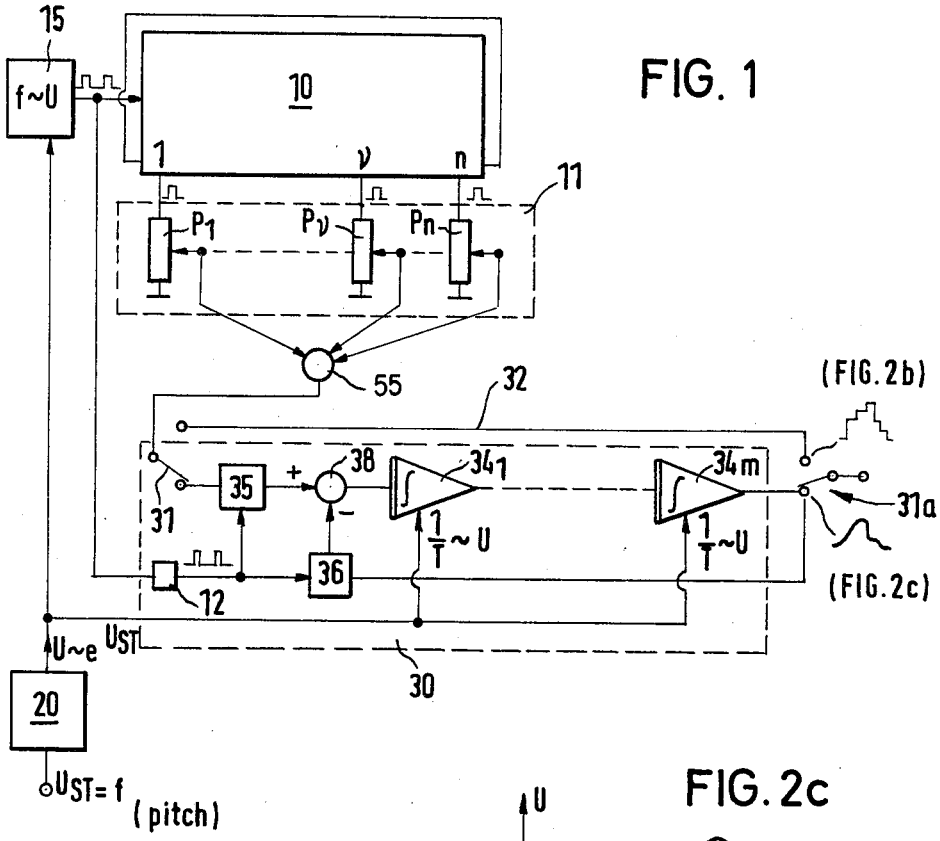
FIG. 1
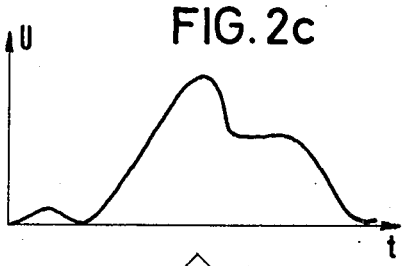
FIG. 2c
FIG. 2a
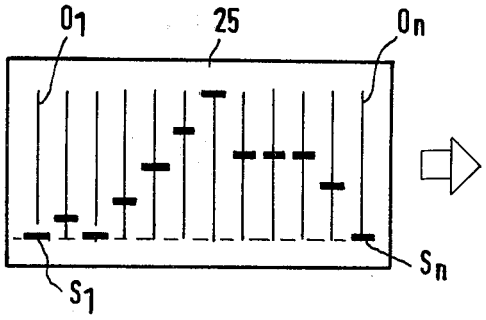
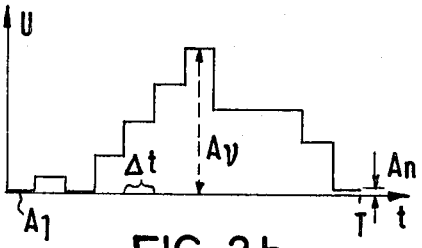
FIG. 2b

WAVE FORM GENERATOR FOR SOUND FORMATION IN AN ELECTRONIC MUSICAL INSTRUMENT

BACKGROUND OF THE INVENTION

The invention relates to a wave form generator for sound formation in an electronic musical instrument with a storage unit having at least two portions, each of which has a set of storage cells for storing one wave form. The scanning values associated with a wave form at predetermined scanning points are stored in the storage cells. Each different storage cell is associated with a corresponding scanning point on a wave form. The generator also has a controllable store read-out device and a smoothing unit connected upstream of the wave form generator output.

Such a wave form generator is known from W. German Disclosure Paper DOS 2,830,483 (K.K. Suwa Seikosha, application date July 11, 1978). In one of the two wave form stores of this known wave form generator, the scanning values of the wave form for a solo melody are stored, while in the other wave form store the scanning values of the wave form of accompanying music are stored. An envelope circuit is connected downstream of each function store for further influencing the sound quality. The smoothing unit connected upstream of the wave form generator output has in particular a digital-to-analog converter or a low-pass filter. The smoothing unit is used for reducing the harmonic content of a stepped wave form, leading to a better simulation of natural tones or notes. In this known device, there is no possibility of modifying the time dependence on the curve shape set by means of the wave form stores and/or the envelope circuit.

W. German Publication Paper DAS 2,237,594 (Nippon Gakki Seizo K.K.; application date July 31, 1972) discloses a wave form generator for an electronic musical instrument having a wave form store which can be read out and also having a set of resistance elements. The scanning values of a wave form are stored in the function store and the resistance values of the resistance elements are set in such a way that, in analog form, their scanning values represent the amplitudes of the wave form. As a result of this type of store design, the disadvantages of digital stores as known from e.g. W. German Disclosure Paper 1,935,306 (Allen Organ Corporation, application date April 15, 1976) are eliminated. However, in this known device, there is no possibility of cross-fading from one wave form to another for changing the spectral synthesis of a note.

It is also known that wave forms with random configurations can be produced with the aid of shift registers, e.g. in the form of ring counters (one of N counters). In this connection, a location in the shift register is associated with the voltage value at a given time, the voltage value generally being in the form of a parallel binary word. Thus, this shift register is able to process a plurality of bits in parallel. In this case, the output is a random location between two shift register cells at which successively appear all the (binary coded) voltage values which occur, during a cycle i.e. which are written into the shift register cells. Advantageously, the Nth, i.e. the last shift register cell is selected as the output. At the end of the cycle, the process starts anew, because the Nth output is fed back to the first input. Thus, the voltage value information stored once in each storage cell travels round continuously. The cycle time is obtained from the product: clock frequency reciprocal x number of storage cells, i.e. $T=\Delta T\times N$, with $\Delta T=1/F$ (clock); N=number of storage cells.

From the German Journal "elrad" 1979, No. 5, page 28, title "Harmonization of digitalised curves", it is known to use a so-called "deglitcher" as the smoothing or interpolation unit for harmonizing digitalised wave forms. The known deglitcher has two sample/scanning and hold elements operating at a common switching point that feeds an input of an integrator and the integrator output is fed back to the input of one sample/-scanning and hold element. The feedback takes place in such a way that the difference between the signal values at the integrator output and the sample/scanning and hold elements respectively appear at the common switching point.

BRIEF SUMMARY OF THE INVENTION

One object of the present invention is to further develop the wave form generator described above while substantially retaining its existing advantages in such a way that the establishment of desired wave form shapes is facilitated, and particularly to permit cross-fading of one wave form to another.

According to the invention, this problem is solved in that the storage cells in the portions of the storage unit of the wave form generator are so associated with one another that the same scanning points are provided for all the wave forms; the storage cells of the different portions associated with the same scanning point are individually controllable by means of a common reversing switch; an interpolation means is connected downstream of each reversing switch; and the output signals of the interpolation means can be successively applied to the smoothing unit means connected upstream of the wave form generator output.

In a digital embodiment of the invention, digital random access memories (RAMS) are provided as the storage unit for the wave form generator and a coder and a microprocessor are connected between the wave form generator input and the RAMS. The microprocessor has a central processing unit (CPU), a read-only memory (ROM) and an enquiry unit for querying the scanning values at the wave form generator input. The microprocessor and the coder are used for writing the scanning values at the wave form generator input into the RAMS, as well as for calculating intermediate values between said scanning values and also for writing said values into the RAMS. In addition to the RAMS the coder and the microprocessor, a clock generator and a control device are provided for fixing the frequency of the read-out cycle with which the CPU reads out the values in each RAM. Between the CPU and the wave form generator output is connected a digital-to-analog converter.

The CPU is constructed in such a way that it is controllable by means of a control key so as to successively determine and read into the RAM the sets of scanning values associated with the individual wave forms and the related intermediate values. The CPU is also designed to calculate transition values between the predetermined wave forms and is connected to a ROM. The RAMS can be combined into a storage unit.

The invention has the advantage that the time dependence of a predetermined or preset wave form can be modified and in particular the predetermined wave form can be converted into another one. This measure makes it possible to substantially replace an envelope store, and to i.e. simulate a transition from one natural instrument to another or a transition from the timbre associated with one instrument to the timbre associated with another instrument. This has the advantage that it is possible to use highly integrated circuits and consequently save a great deal of space. A first smoothing of the wave form initially fixed by the predetermined set of scanning values is obtained in the solution using a microprocessor in that the CPU and ROM calculate intermediate values for the range located between the scanning values and then store said intermediate values between the scanning values in the RAM. After storing the scanning values and intermediate values in the random access memory, all of them are cyclically read out at a frequency determined beforehand by the control device and the clock frequency. The intermediate values between the scanning values (and consequently the order of the interpolation pieces) are controllable by the design of the microprocessor. The order of the transition values between the two wave forms can be also be predetermined by means of the ROM connected to the CPU and can be controlled by means of a feed-in keyboard.

In the invention, the nature of the transition from one predetermined wave form to the next can be fixed by the design of the interpolation circuit. Preferably, the interpolation circuit is designed in such a way that one or more series-connected integrators are connected downstream of each reversing switch, to permit the outputs of the thus formed integrator rows to be successively connected with the smoothing unit. The order of the transitions from one predetermined wave form to the next can be fixed by the number of integrators in each integrator row.

In a further preferred embodiment of the invention, the reversing switches connected downstream of the individual storage cells can be jointly reversed. However, it is also possible to use individually operable reversing switches. Individually operable reversing switches have the advantage that multiplicity of sets of scanning values or wave forms from two predetermined sets of scanning values or their corresponding wave forms can be supplied to the interpolation circuit. Thus, one predetermined wave form can be converted into another wave form by operating a single reversing switch. The operation of another reversing switch will produce a further new wave form. Thus, a multiplicity of wave forms can be produced from only two predetermined wave forms by successive operation of individual reversing switches.

The store read-out means is preferably connected to the outputs of the interpolation circuit or the outputs of the integrator rows formed by the plurality of integrators for the sequential addressing of the storage cells.

In the case of the interpolation circuit produced by the integrators, the course of the transition from one predetermined wave form to the next one is controlled by the constants of the integrators. In order to ensure a gradual transition, the integrators are designed in such a way that their integration time constant is relatively large with respect to the width or duration of the timing pulses of the store read-out means. Preferably, the integrators are designed in such a way that their integration time constants are variable and, in particular, voltage-variable. This also provides an easier way of varying the transitions between predetermined wave forms. The integrators can, for example, be constructed as RC-elements with voltage-controllable resistances.

According to a further preferred embodiment, means are associated with the storage cells of the portions of the storage unit, the means having visibly arranged components which can be connected to the cells. The components are designed in such a way that their overall arrangement represents a reversible, well-defined representation of the overall arrangement of the scanning values of the stored wave form. This has the advantage that the shape of the wave form, to the extent that it is fixed by its scanning values, can be directly graphically read from the image of the overall arrangement of the components. As a result of this manner of determining the shape of the wave form, even the amateur is able to simply set desired wave forms. Thus, if the number of components does not exceed a maximum between 15 and 50, preferably between 15 and 30, a visual or graphic arrangement can easily be noted or compared with a pattern.

U.S. Pat. No. 3,859,884 (Dillon Ross Grable of Jan. 14, 1975) has means with visibly arranged components, provided in such a way that the overall arrangement of the components in each case represents a bijective mapping of the overall arrangement of scanning values within the desired function. In this reference, a smoothing unit is connected upstream of the function generator output for improving the sound quality, but does not permit cross-fading between different wave forms.

Preferably, the components are associated and connected to the storage cells in such a way that the overall arrangement of the components or the image thereof represents a correct-scale reproduction of the overall arrangement of the scanning values or the image of the scanning values within the wave form. Particularly the correct-scale reproduction of the picture of all the scanning values permits conclusions about the wave form configuration to be simply drawn in the case of known and preferably constant smoothing unit characteristics.

In certain cases, it can be desirable to enlarge certain segments of the wave form rather than reproducing them to scale, this being accomplished by the association between the components and the store contents.

The storage cells may be externally controllable by means of the components. Preferably, the scanning values can be written directly into the storage cells by the means of the components.

According to a simplified embodiment, the components are juxtaposed and movable along a substantially straight movement path. Each of these movement paths can be considered as an ordinate and is in one-to-one correspondence with the storage cells in the sequence of successive scanning points, which preferably are regularly spaced. The movement paths are aligned parallel to one another and emanate from a common reference line orthogonal thereto. This reference line can be considered an abscissa, and can have lateral spacings with respect to one another corresponding to the spacing of the scanning points for the scanning values. The association between the components and the store contents is such that the spacing of each component from all other components of a common reference line or abscissa corresponds to the content of the particular storage cell associated therewith. Thus, the scanning values can be directly written into the storage cells by simply displacing the components along their movement paths.

The advantages of analog storage of scanning values are obtained in that the function store comprises analog storage cells, whereby the latter preferably comprise variable resistors.

Preferably, the variable resistors are jointly constructed with the components as wafer switches arranged in a straight row. The components are displaceable at right angles to the only row.

In a preferred embodiment, the visible parts of the components are constructed as elongated members which point parallel to the row. The overall image of the wafer switches or the visible parts of the components consequently gives a direct graphic representation of a step function produced by the scanning values.

For the sequential addressing of the storage cells, the store read-out means preferably has a shift register which reads the scanning values from the storage cells, preferably in identical time intervals. This also facilitates an association between the scanning values and the course of the wave form.

On using a finite number of storage cells, a stepped curve configuration is obtained, because the momentary values of the wave form remain constant within the time interval provided for each scanning point. Thus, according to the invention, the initially stepped output signal corresponding to the scanning values is supplied to a smoothing unit (deglitcher) constructed as an interpolation circuit which, depending on the order of the basic interpolation curve, connects by continuous curve portions the initially (by a corresponding setting of the components) fixed momentary values or scanning values of the function. Thus, when using the wave form generator according to the invention, the expenditure for simulating conventional musical instruments is kept low in the case of an electronic musical instrument. Tests carried out by the applicant have shown that even a limited number of inflection points in the course of a wave form of a tone signal permits a considerable multiplicity of sounds.

According to a further development of the invention, the smoothing unit (preferably constructed as interpolation circuits) has a first input-side sample/hold element whose output is connected to the input of one or more series-connected integrators and the output of the integrator or integrators is fed back to a switching point located between the first sample/hold element and the integrator input in such a way that the difference between the function store output signal and the output signal of the integrator row appears at the integrator input. The feedback loop preferably contains a second sample/hold element.

The order of the interpolation curve can be fixed in a simple manner through the number of integrators used.

In order to ensure that the exact difference between one scanning value and the integrator output value is always formed the inputs of the store read-out means and the first and second sample/hold element are preferably connected parallel to one another with the output of a clock generator, and a monostable flip-flop is connected upstream of the inputs of the sample/hold elements. This flip-flop can be used to reduce the width of the pulses from the clock generator and the smoothing means is timed, preferably with a time lag.

In order to ensure that the difference between the one scanning value only and the integration output value is also formed in the case of a variable clock frequency, the clock generator and the integrator or integrators are designed in such a way that the clock frequency and integration time constants are voltage-controllable, the control inputs of the clock generator and the integrator or integrators being at the output of a common voltage generator. An exponential function generator is suitable as the voltage generator for the wave form generator according to the invention.

BRIEF DESCRIPTION OF THE DRAWINGS

The invention is described in greater detail hereinafter relative to non-limitative embodiments and the attached drawings in which:

FIG. 1 a circuit diagram for a smoothing unit connected upstream of the output of the wave form generator according to the invention.

FIGS. *2a, 2b* and *2c* show a plan view of the overall arrangement of the components and the relationship between the components and the shape of the wave form.

Figure 3:
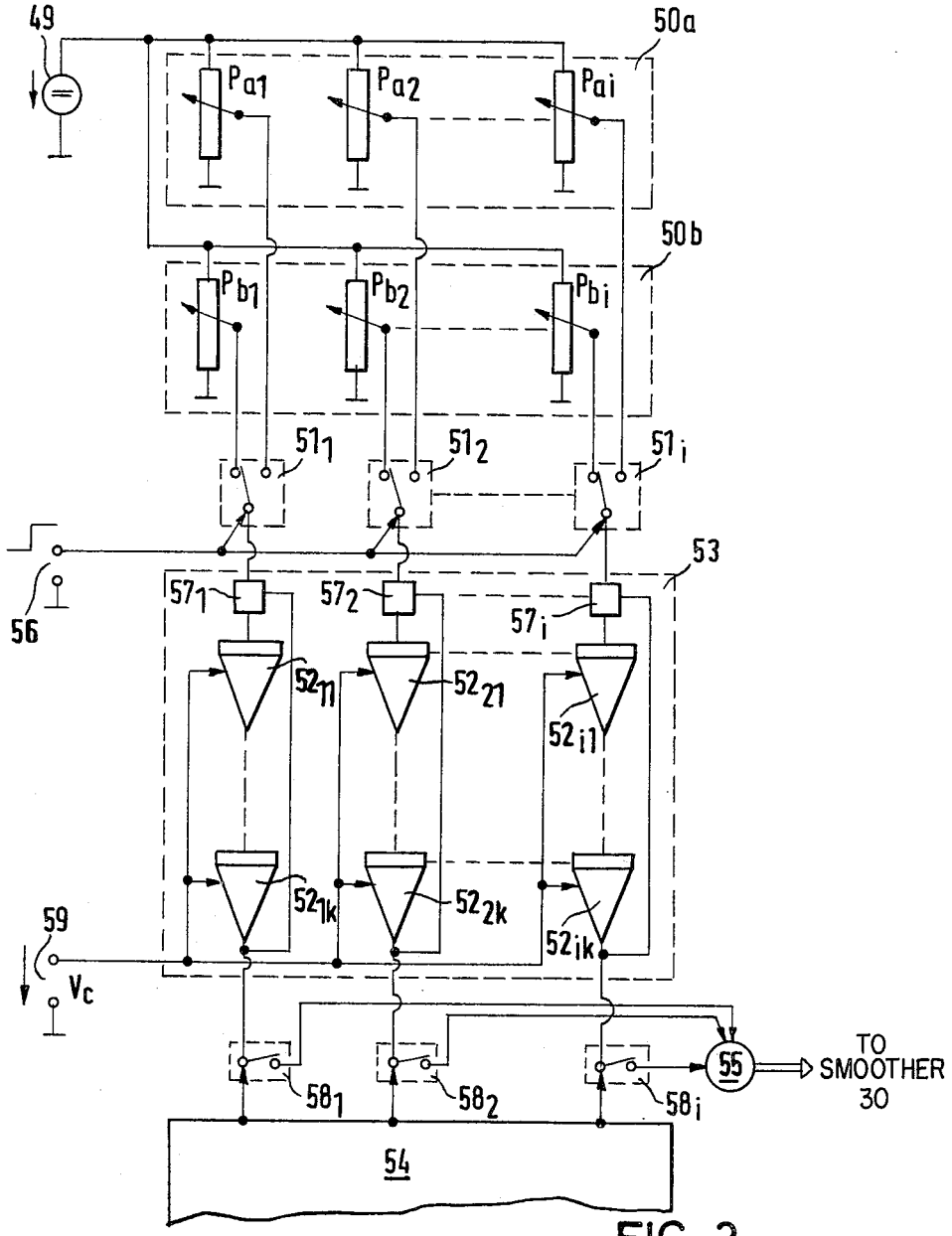

FIG. 3 a diagram of a first embodiment of the invention.

FIGS. *4a, 4b, 4c, 4d* show the relationship between the components and the shape of the wave form according to the first embodiment.

Figure 5:
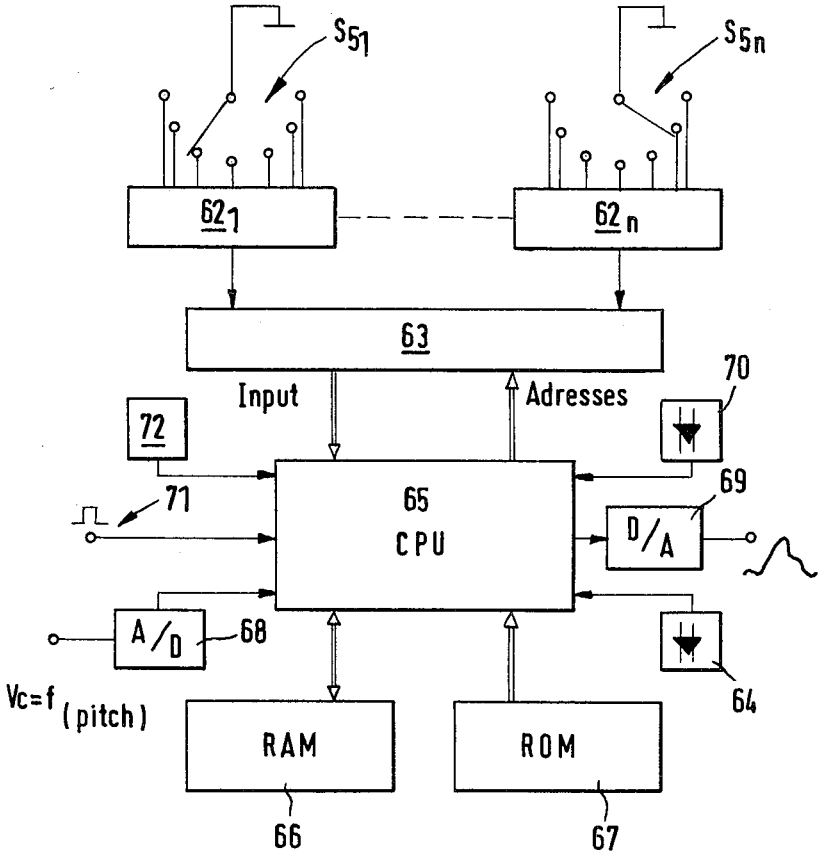

FIG. 5 is a second embodiment of the invention.

DETAILED DESCRIPTION OF THE PREFERRED EMBODIMENTS

Analog technology is used in the circuit diagrams of FIGS. 1 and 2 which illustrate the configuration, application and effect of smoother 30. Square-wave pulses are continuously produced in succession at the shift register outputs 1 to n by a shift register 10 connected as a ring counter. These square-wave pulses all have a constant voltage and substantially serve as a briefly applied constant voltage source for the potentiometers $P_1 \ldots P_n$ connected to the shift register outputs 1 to n. Each shift register output 1 to n supplies a voltage to the potentiometers $P_1 \ldots P_n$ constructed as wafer switches. By adjusting or displacing the wafer switches, different voltages can be tapped from the potentiometers $P_1 \ldots P_n$. These diffferent voltages correspond to the scanning values $A_1 \ldots A_n$ shown in FIG. 2.

All the potentiometers $P_1 \ldots P_2$ shown in FIG. 1 form a function store 11, the potentiometers corresponding to the individual storage cells. Together with a voltage-controllable clock generator 15 and a smoothing unit 30 (described below), shift register 10 serves as the read-out means for the function store 11.

As shown in FIG. 2, the scanning values stored in the function store 11 can be taken from the position of the sliders $S_1 \ldots S_n$ of the wafer switches. This can be seen particularly clearly from FIGS. *2a* and *2b*. In the embodiment shown, a comparison of FIGS. *2a* and *2b* shows that the overall arrangement of the components or sliders $S_1 \ldots S_n$ represents a correct-scale reproduction of the overall arrangement of the scanning values $A_1 \ldots A_n$ within a cycle of the wave form. The wafer switches or potentiometers $P_1 \ldots P_n$ are laterally juxtaposed in a straight row and the sliders $S_1 \ldots S_n$ are displaceable along a straight line which is at right angles to the longitudinal direction of the row of potentiometers. The wafer switches are constructed in such a way that the movement paths $O_1 \ldots O_n$ for sliders $S_1 \ldots S_n$ are parallel to one another and in neutral position the sliders $S_1 \ldots S_n$ are located on a common straight line which is orthogonal to the movement paths $O_1 \ldots O_n$ of sliders $S_1 \ldots S_n$. The lateral spacings of the sliders correspond to the lateral spacings (time intervals) of the scanning values $A_1 \ldots A_n$ provided for the function. The time intervals of scanning values $A_1 \ldots A_n$ admittedly change on modifying the fundamental frequency. However, the relationship of the spacings or time intervals between two scanning values remains constant. As a result, even in the case of varying frequency, the overall arrangement of sliders $S_1 \ldots S_n$ represents a correct-scale reproduction of the overall arrangement of the scanning values $A_1 \ldots A_n$ within a cycle of the wave form. In the present embodiment, the scanning values are externally directly adjustable by displacing the sliders $S_1 \ldots S_n$. The distance of each slider $S_1 \ldots S_n$ from the neutral position corresponds to the content of the particular associated storage cell or the voltage which can be tapped from the particular potentiometer $P_1 \ldots P_n$.

In the present embodiment, the sliders $S_1 \ldots S_n$ are rectangular and have a relatively large extension at right angles to their displacement direction. Thus, the overall arrangement of the sliders $S_1 \ldots S_n$ gives the immediate impression of a step function corresponding to that of FIG. 2*b*. The movement paths $O_1 \ldots O_n$ for sliders $S_1 \ldots S_n$ are constructed as guide slots within the indicating board 25 of a control console.

According to a further embodiment, instead of constructing the components as sliders $S_1 \ldots S_n$ of wafer switches, the wafer content of the storage cells is indicated by spots or electron beams. The storage cells are, for example, once again constructed as potentiometers, preferably rotary potentiometers and the position of the tap terminal is indicated on an indicating board by a spot.

The outputs of potentiometers $P_1 \ldots P_n$ are fed to a common decoupling element 55, which ensures that there is no interaction between the individual potentiometers. The output of decoupling element 55 is supplied to an input of the smoothing unit 30. The control input of smoothing unit 30 is connected to the output of the voltage-controllable clock generator 15. Clock generator 15 supplies timing pulses of constant voltage, the pulses being successively supplied to the potentiometers $P_1 \ldots P_n$ by means of the shift register 10. The voltages which can be tapped from the decoupling element 55 are initially supplied to a first sample/hold element 35 in smoothing unit 30. The output of this sample/hold element 35 is supplied via a switching point 38 to the input of a first voltage-controlled intergrator $\mathbf{34}_1$. In the represented embodiment, further $(m-1)$ integrators $\mathbf{34}_2 \ldots \mathbf{34}_m$ are connected downstream of the first integrator $\mathbf{34}_1$. The output of this integrator sequence is fed back to the input of a second sample/hold element 36, which inverts the integrator output signal and supplies the inverted signal to the switching point 38. Thus, the difference between the signals from decoupling element 55 and the integrator output is formed at switching point 38.

At particular time intervals determined by the clock frequency of clock generator 15 and by the switching time of a monostable flip-flop 12 which controls the two sample/hold elements 35, 36, the smoothing unit 30 compares the momentary or scanning value tapped from decoupling element 55 with the output value of smoothing unit 30. Thus, integrators $\mathbf{34}_1 \ldots \mathbf{34}_m$ only integrate the differences between the momentary amplitudes fixed by potentiometers $p_1 \ldots p_n$ and which are tapped in immediate time succession. The order of the basic interpolation curve shape is fixed by the number of integrators $\mathbf{34}_1 \ldots \mathbf{34}_m$ in sequence. In the case of a frequency change, i.e. on changing the cycle duration of clock generator 15, the integration time constants must simultaneously be modified in inverse proportional manner to the frequency change. This is possible with the voltage-controllable integrators $\mathbf{34}_1 \ldots \mathbf{34}_m$ and the voltage-controllable clock generator 15 because the control inputs of generator 15 and integrators $\mathbf{34}_1 \ldots \mathbf{34}_m$ are arranged parallel to one another at the output of a common voltage generator 20. When using the function generator according to the invention as a wave form generator in an electronic musical instrument, an exponential function generator is suitable as the voltage generator.

By varying the control voltage of voltage generator 20, the clock frequency and integration time constants are simultaneously variable in a desired manner.

A function with a continuous time derivatives can be tapped at the output of the function generator according to the invention. By means of a secondary guide 32 and a reversing switch 31 arranged between decoupling element 55 and the input of smoothing unit 30, the step function fixed by the scanning values can be directly tapped at the output of the function generator. A further reversing switch 31*a* can be provided for the tap.

The step function at the output of decoupling element 55 and the function with continuous time derivative at the function generator output are shown in FIGS. 2*b* and 2*c*.

FIG. 3 shows an embodiment for an analog construction of a time conversion of one wave form into another. In the represented embodiment, two portions 50*a* and 50*b* of a storage unit are provided for storing the scanning values of different step functions in storage cells $Pa_1, Pa_2 \ldots Pa_i$ and $Pb_1, Pb_2 \ldots Pb_i$. The two storage cells in the two portions provided for storing the scanning values of one and the same scanning point of the functions are in each case connected pairwise with a reversing switch $\mathbf{51}_1, \mathbf{51}_2 \ldots \mathbf{51}_i$. By reversing this reversing switch, one of the two storage cells associated with the same scanning point and arranged in the two portions 50*a*, 50*b* can be addressed.

As in the embodiment of FIG. 1, storage cells $Pa_1 \ldots Pa_i$ and $Pb_1 \ldots Pb_i$ are constructed and arranged as wafer switches. The constant voltage source is a d.c. voltage source 49 constantly connected with all the wafer switches.

Figure 4A:
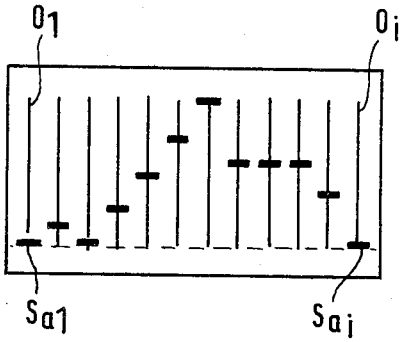
Figure 4C:
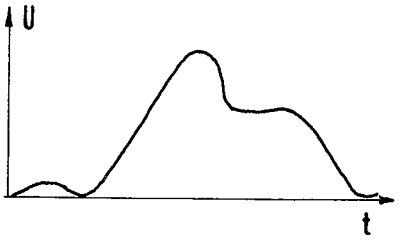
Figure 4D:
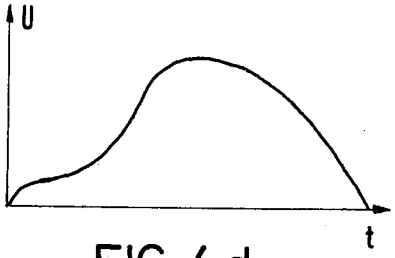
Figure 4B:
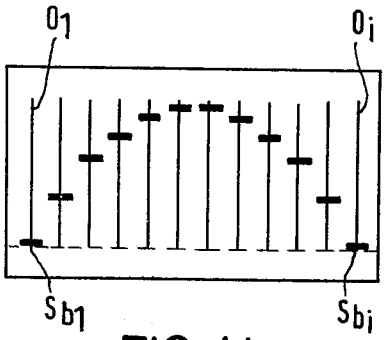

In this embodiment, once again the stepped shape of both wave forms fixed by the two sets of scanning values are directly read from the sliders $Sa_1 \ldots Sa_i$ and $Sb_1 \ldots Sb_i$ according to FIGS. 4*a* and 4*b*.

The inputs of an interpolation circuit 53 are connected to the outputs of reversing switches $\mathbf{51}_1, \mathbf{51}_2 \ldots \mathbf{5}_i$. After reversing reversing switches $\mathbf{51}_1 \ldots \mathbf{51}_i$ from one portion 50*a* or 50*b* of the storage unit to the other one the interpolation circuit 53 brings about a gradual conversion from the first wave form to the second wave form. After releasing a trigger circuit 56. e.g. after depressing a key in the case of a musical instrument the "trigger" input changes its potential from e.g. negative to positive, so that reversing switches $\mathbf{51}_1 \ldots \mathbf{51}_i$ jointly switch over from the portion 50*a* associated with the starting wave form to portion 50*b* associated with the end wave form. Thus, reversing switches $\mathbf{51}_1 \ldots \mathbf{51}_i$ are voltage-controllable switches. Trigger circuit 56 preferably has a flip-flop. By reversing the reversing switches, the signal applied by the first portion 50*a* to interpolation circuit 53 changes over into the signal corresponding to the content of the second portion 50*b*.

Interpolation circuit 53 preferably has a number of rows of successively connected integrators $52_{11}$ to $52_{1k}$, $52_{21}$ to $52_{2k}$ . . . $52_{i1}$ to $52_{ik}$ equal to the number of storage cells. In each case, one integrator row is connected to the output of one reversing switch. The integrator rows are designed in such a way that the value which can be tapped at the integrator row output coincides, after integration, with the value obtained at the integrator row input. In the case of RC-element integrators, this condition is fulfilled. Instead of using RC-elements, differentiators $57_1$ . . . $57_i$ can be connected between the reversing switches $51_1$ . . . $51_i$ and integrator rows $52_{11}$ to $52_{1k}$ . . . $52_{i1}$ to $52_{ik}$ which supply the differences of the values successively obtained in the reversing switch output to the rows of integrators. Integrators $52_{11}$ . . . $52_{ik}$ are designed in such a way that their integration time constant is variable by means of the control voltage unit 59. As a function of the number of integrators successively connected in an integrator row and the selection of the voltage of control voltage unit 59, a more or less rapid, continuous transition of the integrator output voltages is obtained from a first stepped curve shape fixed by portion 50*a* to a second stepped curve shape according to the scanning values written into the second portion 50*b*. The outputs of the integrator rows are successively connected to the decoupling element by means of voltage-controllable switches $58_1$, $58_2$ . . . $58_i$ and a shift register 54. At the output thereof, they bring about a substantially stepped curve function converted by means of the smoothing unit 30 described relative to FIG. 1 into a wave form with a continuous time derivative.

The integration time constant of integrators $51_{11}$ . . . $52_{ik}$ is relatively large compared with the clock frequency of shift register 54 and is advantageously on the order of seconds.

Depending on the number of switching points of each reversing switch $51_1$ . . . $51_i$ and the number of portions 50*a*, 50*b* or potentiometer rows $Pa_1$ . . . $Pa_i$, $Pb_1$ . . . $Pb_i$, etc., a successive changeover to a plurality of randomly varying wave forms can be obtained by corresponding control by means of the trigger signal at the trigger input of trigger circuit 56. Thus, for example, a sine wave is read into one of the portions of the storage unit, the latter is able to economize on a corresponding, downstream-connected, narrow-band filter, preferably a low pass filter.

Figure 4E:
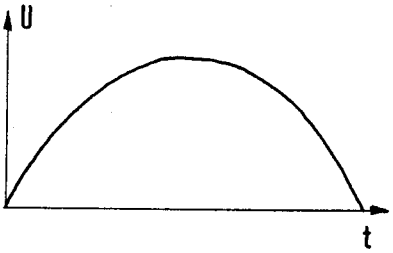

The transition between the wave forms is illustrated in FIGS. 4*c* to 4*e*. FIG. 4*c* shows an initial curve shape which can be tapped at the function generator output, FIG. 4*d* a transition curve shape and FIG. 4*e* the final curve shape which can be tapped at the function generator.

FIG. 5 shows an embodiment of the invention in digital technology. In this embodiment, the scanning value is given beforehand as a binary word by means of a multiple slide switch $S_{51}$ . . . $S_{5n}$ and subsequently connected coders $62_1$ . . . $62_n$. By depressing a control key 64, the central processing unit or CPU 65 of a microprocessor with the initial aid of an enquiry unit 63 successively reads into a random access memory or RAM 66 the binary coded words provided by the slide switches $S_{51}$ . . . $S_{5n}$. The CPU 65 of the microprocessor is designed in such a way that, by means of a read-only memory ROM 67, it calculates intermediate values between each two adjacent words previously read into the RAM 66 and stores them in the latter under another storage address. The addresses of the binary words in the RAM 66 are then arranged in the CPU 65 in such a way that the calculated intermediate values are between two binary words fed in by means of the slide switches $S_{51}$ . . . $S_{5n}$. The frequency-determining signal and the control voltage input VC is then converted by means of an analog-to-digital converter 68 into a binary word and is used for fixing a time which can be derived from the clock frequency of a clock generator 72. The momentary function values in the RAM 66 are then switched in cyclically recurring order by CPU 65 to a digital-to-analog converter 69 in such a way that the running addresses associated with the momentary function values are constantly successively applied to the address collecting line for the RAM 66 with the indicated clock frequency by a counter in the CPU 65. After converting the digital values from CPU 65 into analog values by means of the digital-to-analog converter 69, the desired signal or wave form can then be tapped at the output of the function generator.

To obtain a gradual transition from a first wave form into a second wave form by means of the present digital embodiment, it is necessary to modify the microprocessor design. The microprocessor is designed in such a way that by depressing the control key 64 the momentary values of the function set with the slide switches $S_{51}$ . . . $S_{5n}$ are read into the RAM 66 and by means of the ROM 67 and CPU 65 intermediate values are calculated and are correspondingly stored in the RAM 66. By again depressing the control key 65, the values of a second wave form set by slide switches $S_{51}$ . . . $S_{5n}$ can be read in. The microprocessor is now constructed in such a way that, after storing the scanning values of the second waveform in RAM 66 and also calculating and storing the corresponding intermediate values in RAM 66, transition values are calculated by means of CPU 65 and ROM 67 in stepped manner for the momentary values, including the subsequently calculated intermediate values and are then stored between the associated momentary values of the first and second waveforms in RAM 66. Thus, all values are stored in the RAM 66 in that chronological order calculated for the function transition. After fixing the clock frequency by means of the voltage signal applied at control input Vc and the analog-to-digital converter 68, it is possible to read out the storage cells of RAM 66 by means of a trigger pulse at trigger input 71. To economize on storage locations, individual address zones in RAM 66 can be read out several times in succession, as a function of the design of the ROM 67. This depends on the desired fineness of gradation of the transition from one wave form to the other.

In this embodiment, it is once again possible to modify the time dependence of the transition from one wave form to the other. For this purpose a control keyboard 70 is provided, which can be used for feeding a predeterminable transition curve into the microprocessor. In this case, the transition from one wave form to the other follows a pattern which can be given by means of slide switches arranged on the control keyboard 70 like previously described switches $S_{51}$ . . . $S_{5n}$ (and not the preferable exponential pattern for musical instruments, which may be stored in the ROM 67). Thus, in this embodiment, the transition curve between two wave forms is externally controllable and can be read from the outside by means of the slide switch positions. The position of the slide switches on the keyboard 70 is queried in the previously described manner by means of enquiry unit 63 and central processing unit 65 after depressing a control key in keyboard 70 and is read into the RAM 66. If particularly fine gradations are required, intermediate values can again be calculated by means of CPU 65 and ROM 67 and can be read into the RAM 66 between the momentary values of the function corresponding to the switch positions. The thus established curve pattern is then used for forming the transition values from one wave form to the other. Only when the complete time dependence, including the gradual transition from one wave form to the other is present in sequence in the RAM 66 can the shape of the wave form be tapped from the function generator output in the desired frequency after receiving a trigger pulse at trigger input 71 following the evaluation of the frequency-determined code word at the output of the analog-to-digital converter 68.

Summarizing, in connection with this embodiment it can be seen that initially mathematically intermediate values are calculated for each of the graphically set curve forms on switches $S_{51} \ldots S_{5n}$ (initial wave form, end wave form, curve pattern of transition from one wave form to the other). FIG. 6 only shows which group $S_{51} \ldots S_{5n}$ $S_{5n}$. However, in this embodiment, a separate switch group is provided for each wave form as in the second embodiment according to FIGS. 3 and 4. All the momentary values of the function from the initial wave form values to the end wave form values are sequentially arranged in the RAM 66. Optionally, the addresses belonging to a wave form cycle are read out successively a number of times before the following addresses of the wave form closer to the course of the end wave form on the time axis are read out. The values in the RAM 66 are successively applied to the output of the digital-to-analog converter 69 with the clock frequency fixed by means of the control voltage at control voltage input Vc and analog-digital converter 68. The separation between the mathematical interpolation of the wave form intermediate values and their output in the desired frequency takes account of the generally relatively low calculation speed of microprocessors, which does not generally permit a real time interpolation.

What is claimed is:

1. A wave form generator providing a signal useful for sound formation in an electronic musical instrument, said generator comprising:

a storage unit having a plurality of portions each storing scanning values corresponding to predefined sequential scanning points of a different predetermined wave form;

a set of storage cells in each of said storage unit portions, each cell in a set storing the scanning value at a corresponding scanning point of the wave form of the corresponding storage unit portion;

switching means having for each scanning point a corresponding output and a corresponding plurality of inputs, each input of said plurality being associated with a different wave form by being connected to a different storage unit portion at a storage cell corresponding to the scanning point of the respective switching means output, and means for selectively connecting one input of each plurality to the respective output;

interpolation means for providing transition values between successive scanning values of the same switching means output for each switching means output thereby providing interpolation between different wave forms;

smoothing unit means for providing intermediate values between the scanning values of different switching means outputs, thereby providing smoothing for each wave form; and means for combining said scanning values, said intermediate values and said transition values, the scanning values being combined in the sequence of the respective scanning points, the intermediate values being inserted in sequence between the respective scanning points between which they are provided by said smoothing unit means and the transition points being inserted in sequence between the respective scanning values between which they are provided by said interpolation means.

2. A wave form generator according to claim 1, wherein the interpolation means has one or more series-connected integrators which are successively connectable with the smoothing unit.

3. A wave form generator according to claims 1 or 2, wherein the switching means can be jointly switched over from one storage cell to the other storage cell.

4. A wave form generator according to claim 2, wherein a store read-out means for the sequential addressing of the storage cells is connected to the outputs of the rows of integrators.

5. A wave form generator according to claim 4, wherein the integration time constant of the integrators is larger than the timing pulse cycle period of the store read-out means and the integration time constants of the integrators are controllable, particularly voltage-controllable.

6. A wave form generator according to claim 1, wherein at least a portion of said storage unit is incorporated in a digital random access memory (RAM), said switching means, said interpolation means, said combining means and said smoothing unit means being included in a microprocessor means, said wave form generator further comprising:

coder means for converting the values of said wave forms at scanning points into digital form, said coder means communicating with said RAM through said microprocessor means; and a digital-to-analog converter responding to said microprocessor means to provide a smoothed composite signal;

said microprocessor means comprising:

an enquiry unit controllable to receive wave form values in digital form from said coder means;

a central processing unit (CPU) controlling said enquiry unit and acting to transfer ditigal signals therefrom to said RAM and from said RAM to said digital-to-analog converter;

a read-only memory (ROM) controlling said CPU, said CPU controlling said enquiry unit to sequentially query scanning values of each wave form, said ROM coacting with said CPU to calculate values intermediate said sequential scanning values within each wave form, for calculating trnasition values between corresponding scanning values in different wave forms and for sequentially writing said values into said RAM, said CPU providing sequential values corresponding to a given wave form from said RAM to said digital-to-analog converter.

7. A wave form generator as in claim 6, further comprising a clock generator and control means cooperating to fix the frequency of the read-out cycle with which values in said RAM are read out under control of said CPU and are provided to said digital-to-analog converter, and key means communicating with said CPU to control communication between said CPU and said enquery unit.

8. A wave form generator according to claim 7, wherein central processing unit is controllable by means of a further keyboard for modifying the course of the transition values between the wave forms.

9. A wave form generator according to claim 8, wherein the storage cells of the function stores are analog storage cells, particularly variable resistors.

10. A wave form generator according to claim 9, wherein the variable resistors are constructed together with the components to form wafer switches laterally displaceably juxtaposed in a straight line at right angles to the longitudinal direction of said row.

11. A wave form generator according to any one of claims 1, 2 or 4–8, wherein means having visibly arranged components connectable with the storage cells is associated with the storage cells of each function store in such a way that the overall arrangement of the components in each case represents a one-to-one correspondence of the overall arrangement of the stored scanning values of the wave form.

12. A wave form generator according to claim 11, wherein the storage cells of the function stores are externally controllable by means of the components and in particular can be filled with the scanning values by said components.

13. A wave form generator according to claim 11, wherein the components are juxtaposed, are in each case movable along a substantially straight movement path and are associated in one-by-one correspondence with the storage cells in the sequence of successive scanning points, whereby the movement paths are parallel to one another, emanate from a common reference line orthogonal thereto and have lateral spacings with respect to one another corresponding to those of the scanning points for the scanning values and the distance of each component from the reference line corresponds to the information content of the particular storage cells associated therewith.

14. A wave form generator according to claim 11, wherein the store read-out means comprises a shift register.

15. A wave form generator according to claim 11, wherein the smoothing unit has a first input-side sample/hold element and the output thereof is connected to the input of one or more successively connected integrators and the output of the integrator or integrators is fed-back to a switching point located between the first sample/hold element and the integrator input, particularly by means of a second sample/hold element in such a way that the difference between the output signal of the function store and the output signal of the integrator or integrators is present at the integrator input.

16. A wave form generator according to claim 15, wherein the inputs of the store read-out means as well as the first and second sample/hold element are connected parallel to one another with the output of a clock generator and a delay stage, particularly a monostable flip-flop is connected upstream of the sample/hold elements.

17. A wave form generator according to claim 15, wherein the clock frequency of the clock generator and the integration time constants of the integrator or integrators are voltage-controllable and the control inputs of clock generator, as well as the integrator or integrators are connected to the output of a common voltage generator, particularly an exponential function generator.

* * * * *